United States Patent [19]

Alemán-Muciño

[11] 4,189,794

[45] Feb. 26, 1980

[54] TOILET SEAT

[76] Inventor: Pedro Alemán-Muciño, Lluvia No. 317 México City 20, Mexico

[21] Appl. No.: 915,835

[22] Filed: Jun. 15, 1978

[30] Foreign Application Priority Data

Jun. 23, 1977 [MX] Mexico ..... 169584

[51] Int. Cl.[2] ..... A47K 13/00

[52] U.S. Cl. ..... 4/237; 4/239; 128/377; D23/71

[58] Field of Search ..... 4/185.5, 112, 234, 300, 4/237, 239, DIG.8; 128/283, 377, 70, 132R; D23/71; 128/70, 132 R

[56] References Cited

U.S. PATENT DOCUMENTS

| | | | |
|---|---|---|---|
| D. 45,134 | 1/1914 | Waltensperger | 04/237 |
| 1,055,219 | 3/1913 | Pilkington | D23/71 X |
| 2,256,994 | 9/1941 | Warshaw | 4/237 |
| 2,550,221 | 4/1951 | Calderon | 4/237 |
| 2,575,208 | 11/1951 | Calderon | 4/237 |
| 4,048,679 | 9/1977 | Garnett | 4/237 |

FOREIGN PATENT DOCUMENTS

| | | | |
|---|---|---|---|
| 4987 | 9/1905 | France | 4/234 |

OTHER PUBLICATIONS

"The Bathroom Criteria for Design"; pp. 62–73 by A. Kira, Copyright 1966 Cornell Univ. N.Y. Lib. of Congress Catalogue Card No. 66–17889.

*Primary Examiner*—Stuart S. Levy
*Attorney, Agent, or Firm*—Ladas, Parry, Von Gehr, Goldsmith & Deschamps

[57] ABSTRACT

A toilet seat incorporating two pairs of moldings of which:

(a) the first pair consists of two ridges of reciprocally symmetric form, each of them taking an elongated configuration with slight curvature of internal concavity and of variable contour;

(b) the second pair of moldings, also reciprocally symmetric, also takes a curvature of irregular non-angular shape having its forward ends projected slightly toward the middle and joined at their posterior ends to the internal rim of the toilet seat;

(c) the said pairs of moldings are located on the toilet seat, the first pair of moldings being located at the extreme parallel curves of the toilet seat and the second pair of moldings at the inner rear portion of the toilet seat directed toward the front at both sides of the rear center thereof.

3 Claims, 5 Drawing Figures

TOILET SEAT

SUMMARY OF THE INVENTION

This invention refers to a system of moldings which, by their special arrangement and design, as well as their purpose, are of a novel character. This system has as its object the treatment of intestinal constipation, facilitating and making more effective the physiological phenomena involved in the evacuation of the intestine. This objective is acheived, first, by means of two lateral and symmetric moldings, one on the right and the other on the left, built into or adapted along the two lateral right and left portions of a toilet seat, and second, by means of two posterior symmetric moldings, respectively left and right, built into or adapted to the rear portion of the toilet seat and projecting forward. The moldings can be manufactured out of any natural or synthetic material with varying characteristics, provided they meet the requirements necessary for its function. The form, position and dimensions of the moldings may vary within the limits allowed by their function. The moldings may be either incorporated into or adapted to the toilet seat, and in the latter case may be replaceable. When the present physio-anatomic system incorporated into or adapted to a toilet seat functions, as the consequence of the position and design of the moldings which make it up, the latter apply pressure upon specific anatomic bilateral and symmetric structures, with the result that, in the first place, the perineum acquires greater firmness, and that in the second place, the rectum experiences a reduction of its volumetric capacity, in order to increase the pressure which is developed therein prior to the evacuation. When the increased intrarectal pressure is applied upon the resisting perineum, an easier and more complete evacuation of the intestinal contents is achieved.

BRIEF DESCRIPTION OF THE DRAWINGS

The details and characteristics of this physio-anatomic system are clearly shown in the following description and in the drawings which accompany it, as an illustration thereof. The same reference indicia identify the same parts in the several figures.

DETAILED DESCRIPTION OF THE INVENTION

Figure 1:
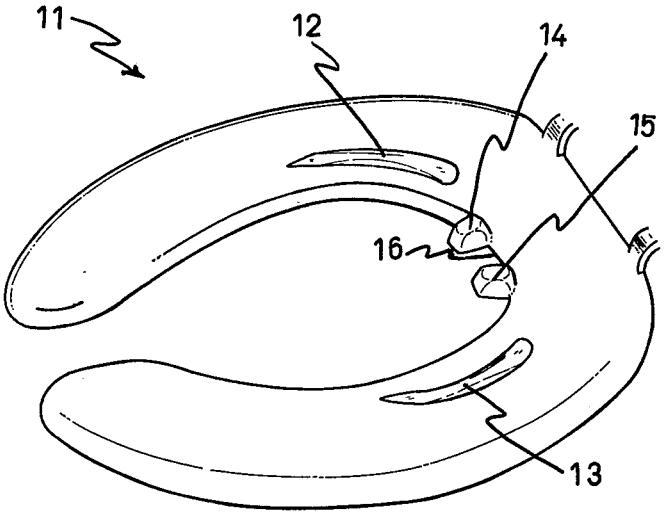
FIG. 1 is a conventional perspective of the four moldings which make up the physio-anatomic system as incorporated into or adapted to a toilet seat.

Referring now to FIG. 1, toilet seat 11 shows the moldings which make up the physio-anatomic system in their respective positions, either built into or adapted to the toilet seat. The right lateral molding 13 is located along and on the rear half of the right side of the toilet seat 11, and the left lateral molding is placed along and on the rear half of the left side of the toilet seat 11; the two moldings are respectively symmetrical in their position, dimensions and shape. The posterior right molding 14 and the posterior left molding 15 are placed adjoining the interior rim 16 of the toilet seat 11. Both posterior moldings 14 and 15 are respectively symmetrical in their position, dimensions and shape.

Figure 2:
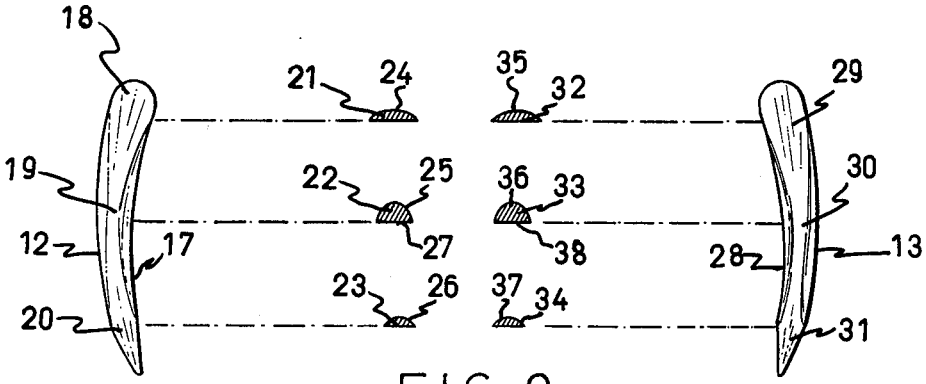
FIG. 2 is a perspective in plan of the lateral right and left moldings, with three vertical projections of three cross-sections of each.

FIG. 2 shows the lateral molding 12 in the position which it occupies upon the surface of the toilet seat 11, and makes perceptible its light curvature consisting of concavity on the inside portion 17; cross-sections 18, 19 and 20 shown with dashed lines are shown in vertical projections 21, 22 and 23 which make evident the changes in height of the upper convexity 24, 25 and 26, thus giving a clear idea of how the convexity diminishes toward the ends of the molding. Bases 27, 27 and 27 are shown with a horizontal shape, which can be varied to accommodate the design to the toilet seat 11 to which the molding 12 is to be incorporated or adapted.

Left lateral molding 13, its internal concavity 28, cross-sections 29, 30 and 31, its vertical projections 32, 33 and 34, its convexity 35, 36 and 37, as well as its base 38, are all consistent with the description already set forth with regard to right lateral molding 12, bearing in mind that both lateral moldings 12 and 13 are reciprocally symmetric in position, dimensions and shape.

Figure 3:
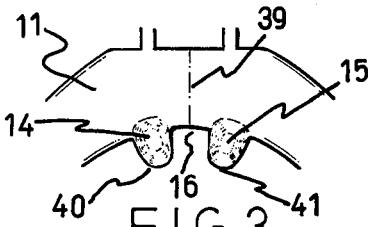
FIG. 3 is a perspective in plan of the posterior left and posterior right moldings built into or adapted to the rear portion of a toilet seat.

FIG. 3 shows a view from above of the posterior portion of the toilet seat 11, to the inner rim 16 of which at equidistant positions from the center line 39 the right posterior molding 14 and left posterior molding 15 have been incorporated or attached; their longitudinal axes tend to a slight convergence toward the front, and the free ends 40 and 41 thereof exhibit their convex shape in the horizontal direction.

Figure 4:
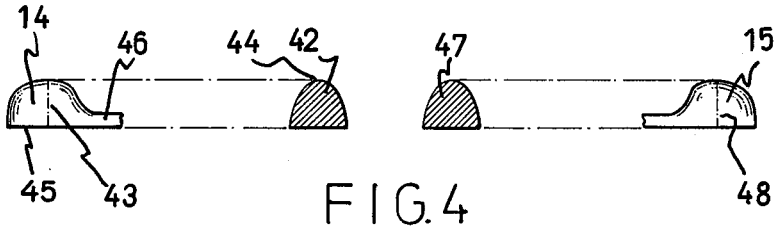
FIG. 4 is a side perspective view of the posterior left and posterior right moldings, with a vertical projection of a cross-section of each of them.

FIG. 4 shows a lateral perspective of the right posterior molding 14 and a vertical projection 42 of a cross-section marked with broken lines 43; lateral perspective view 14 shows in direction from front to rear the convexity of the upper surface 44 of molding 14. Vertical projection 42 shows in cross-section the same upper convexity 44. When the upper surface 44 is thus seen both in a longitudinal and a cross-sectional direction, it is evident that the said surface resembles half an ovoid with a convex upper surface and flat under surface; portion 46 represents the line of fusion with or adaptation to the inner rim 16 of the toilet seat by molding 14. In addition it also shows the lateral perspective of the left posterior molding 15, its vertical projection 47 from the cross-section 48, and all of its other characteristics which coincide with the description already given in reference to the right posterior molding 14, since both moldings 14 and 15 are reciprocally symmetrical in their position, dimensions and shape.

Figure 5:
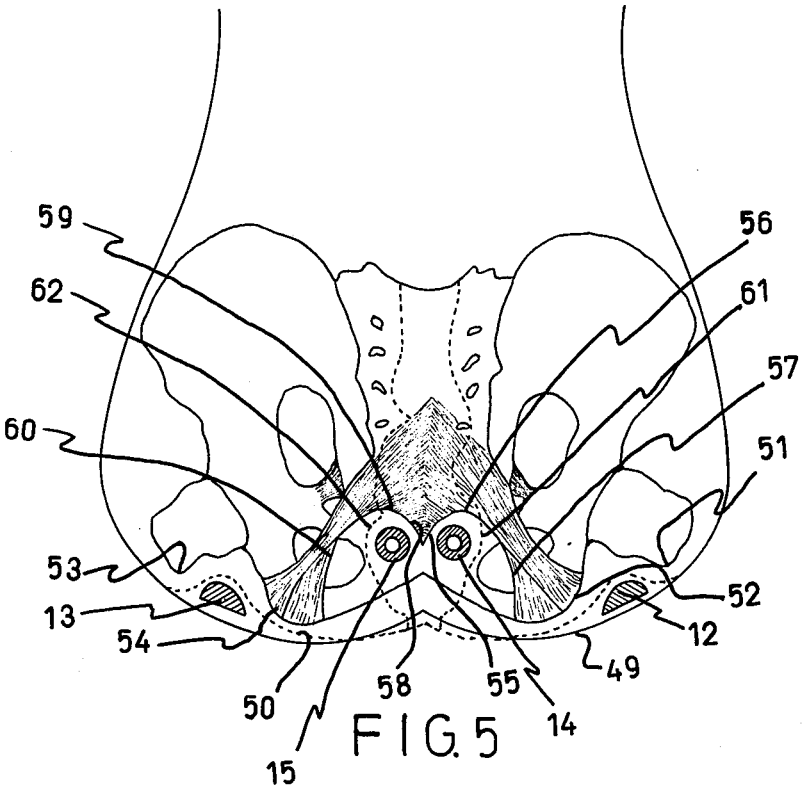
FIG. 5 is an anatomic sketch of the human pelvis and the structures which are related to the invention here described.

FIG. 5 is an anatomical diagram showing the posterior view of the human pelvis and the structures which are involved in the functioning of the physio-anatomic system which is described, considering the human subject in the seated position and viewed from behind.

When the physio-anatomic system built into or adapted to a toilet seat is utilized, the right lateral molding 12 is situated between the greater trochanter 51 of the right femur to the outside, and the right tuberosity of the ischium 52 toward the inside; the left lateral molding 13 is situated between the greater trochanter 53 of the left femur to the outside and the left tuberosity of the ischium 54 to the inside. These two moldings, applying pressure in the positions indicated, apply traction to the skin 49 and place it in the position 50 marked with broken lines; this bilateral traction includes the soft structures subjacent to the skin 50, and allows the perineum to acquire greater firmness.

For the sake of greater clarity, the right posterior molding 14 and the left posterior molding 15 have been indicated with circles in heavy shading: when the toilet seat to which the physio-anatomic system has been incorporated or adapted is used, the right posterior molding 14 applies pressure, placing itself in the space comprehended between the lateral border of the coccyx 55 to the inside, the fibers of the inferior horizontal portion of the great right sacrosciatic ligament 56 upwardly, and the descending inferior fibers of the same great sacrosciatic ligament 57 to the outside; the left posterior molding 15 applies pressure placing itself in the space comprised between the left lateral border of the coccyx 58 to the inside, the fibers of the inferior horizontal portion of the great left sacrosciatic ligament 59 upwardly, and the descending inferior fibers of the external portion of the same great sacrosciatic ligament 60 to the outside. The anatomical regions upon which the right posterior molding 14 and the left posterior molding 15 apply pressure are formed of soft tissues which are immediately adjacent to the posterior-lateral walls of the rectum, shown by broken lines to the right 61 and to the left 62. The simultaneous pressure applied by the right posterior molding 14 and the left posterior molding 15 depresses the posterior-lateral walls of the rectum, right 61 and left 62, thus reducing the dimensions of the rectal cavity and providing better support to its walls. The diminution in the dimensions of the rectal cavity permits of increasing the pressure which prior to the evacuation thereof is developed in the interior of the rectum.

Consequently the functioning of the posterior moldings 14 and 15 brings about an increase in the intrarectal pressure, and the functioning of the lateral moldings 12 and 13 affords greater firmness to the perineum. The increase of the intrarectal pressure efficiently projects the intestinal contents upon a perineum having greater firmness, and the effect is to permit of an easier and more complete evacuation. In this way, the physio-anatomic system performs its function for treating intestinal constipation.

It will be understood, of course, that while the forms of the invention herein shown and described constitute preferred embodiments of the invention, it is not intended herein to illustrate all of the equivalent forms or ramifications thereof. It will also be understood that the words used are words of description rather than of limitation, and that various changes may be made without departing from the spirit or scope of the invention herein desclosed. It is aimed in the appended claims to cover all such changes as fall within the true spirit and scope of the invention.

What I claim as new and desired to secure by Letters Patent of the United States is:

1. A toilet seat comprising a body having spaced side portions and at least a rear portion together defining an opening, a first pair of spaced posterior protuberances each have a longidutinal section which has substantially the shape of half avoid and projecting inwardly into said opening from said rear portion and a second pair of lateral protuberances upstanding one on the uppermost surface of each said side portion, posterior protuberances being spaced apart and located to engage one between the coccyx and the upper and outer portions of the great right sacrosciatic ligament and the other between the coccyx and the upper and outer portions of the great left sacrosciatic ligament of a person seated on said seat.

2. A toilet seat comprising a bocy having spaced side portions and at least a rear portion together defining an opening, a first pair of spaced posterior protuberances projecting inwardly into said opening from said rear portion and a second pair of lateral protuberances upstanding one on the uppermost surface of each said side portion, said lateral protuberances being bowed along the respective lengths thereof and each exhibiting a maximum height in the central region thereof and diminishing to zones of lesser heights towards the ends thereof, said lateral protuberances being located one to engage between the greater trochanter of the right femur and the right tuberosity of the ischium and the other to engage between the greater trochanter of the left femur and the left tuberosity of the ischium of a person seated on said seat.

3. A toilet seat as in claims 1 or 2, wherein the posterior protuberances and the lateral protuberances are molded integrally with said seat.

* * * * *